US010544025B1

(12) United States Patent
Roth

(10) Patent No.: US 10,544,025 B1
(45) Date of Patent: Jan. 28, 2020

(54) APPLIANCE FOR OPENING SCREW AND TWIST TYPE CONTAINERS

(71) Applicant: Paul F. Roth, Bloomfield Hills, MI (US)

(72) Inventor: Paul F. Roth, Bloomfield Hills, MI (US)

( * ) Notice: Subject to any disclaimer, the term of this patent is extended or adjusted under 35 U.S.C. 154(b) by 231 days.

(21) Appl. No.: 15/476,346

(22) Filed: Mar. 31, 2017

Related U.S. Application Data

(63) Continuation-in-part of application No. 14/257,542, filed on Apr. 21, 2014, now Pat. No. 9,630,824.

(51) Int. Cl.
*B67B 7/18* (2006.01)

(52) U.S. Cl.
CPC ..... *B67B 7/18* (2013.01)

(58) Field of Classification Search
CPC ..... B67B 7/18; B67B 7/16; B67B 3/2006; B67B 7/0452; B67B 7/186; B67B 7/00; B67B 3/206; B67B 7/44
See application file for complete search history.

(56) References Cited

U.S. PATENT DOCUMENTS

| | | | | |
|---|---|---|---|---|
| 186,240 | A | | 1/1877 | Donahue |
| 298,508 | A | | 5/1884 | Metcalf |
| 1,111,998 | A | | 9/1914 | Duvall |
| 1,593,947 | A | | 7/1926 | Miller |
| 1,841,270 | A | | 1/1932 | Aeschbach |
| 1,887,152 | A | | 11/1932 | Geisler |
| 2,671,362 | A | * | 3/1954 | Wilson ..... B67B 7/18 81/120 |
| 2,810,311 | A | * | 10/1957 | Smith ..... B67B 3/2006 81/120 |
| 3,044,597 | A | | 7/1962 | Mikhailov |
| D208,321 | S | * | 8/1967 | Brown ..... 81/3.4 |
| 4,085,632 | A | | 4/1978 | Hogan et al. |
| D258,192 | S | * | 2/1981 | Maloney ..... D8/18 |
| 4,262,560 | A | | 4/1981 | Hoffberger |
| 5,154,101 | A | * | 10/1992 | Wolford ..... B67B 7/18 81/3.09 |
| 5,664,466 | A | | 9/1997 | Miller |
| 5,943,920 | A | * | 8/1999 | McGivern ..... B67B 7/18 81/3.25 |
| 6,516,687 | B1 | | 2/2003 | Hile et al. |

(Continued)

*Primary Examiner* — Robert J Scruggs
(74) *Attorney, Agent, or Firm* — Young Basile Hanlon & MacFarlane, P.C.

(57) ABSTRACT

An appliance for opening screw and twist type containers for prescription medicine bottles, water bottles, sports drinks, and jars of nearly all sizes. The appliance has a thermoplastic body with an integrally molded low profile unidirectional gripping blade being positioned on the center line of the appliance. The appliance has an optimized offset from center line loading ramp and reaction plane resulting in a highly efficient opener with an asymmetrical split V type geometry. The appliance provides the optimal leverage, retention, and gripping force required to greatly ease in the removal of screw or twist type container lids ranging in size from ½" to 4½" in diameter. This under cabinet mounted appliance provides unprecedented ease in opening even the most difficult twist type container or jar, which is very beneficial for the aging, as well as the young, and those with arthritic conditions or other hand related problems.

17 Claims, 11 Drawing Sheets

(56) References Cited

U.S. PATENT DOCUMENTS

| | | | | |
|---|---|---|---|---|
| 9,630,824 | B1 * | 4/2017 | Roth | B67B 7/18 |
| 2003/0079567 | A1 | 5/2003 | Dubois et al. | |
| 2012/0304597 | A1 | 12/2012 | Mikhailov | |
| 2013/0186240 | A1 | 7/2013 | Donahue | |
| 2013/0298508 | A1 | 11/2013 | Metcalf | |

* cited by examiner

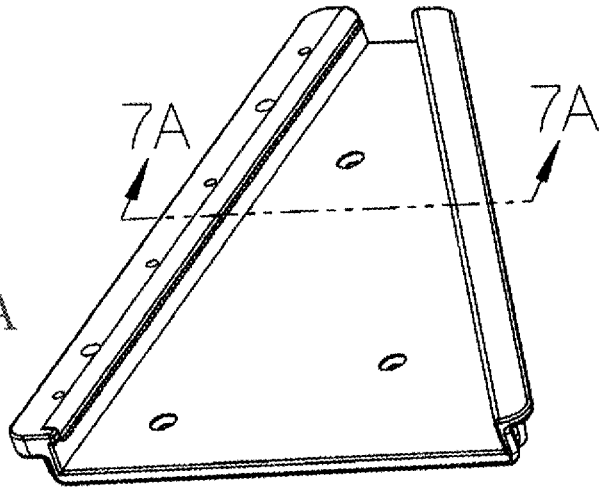
FIG. 7A
FIG. 7B
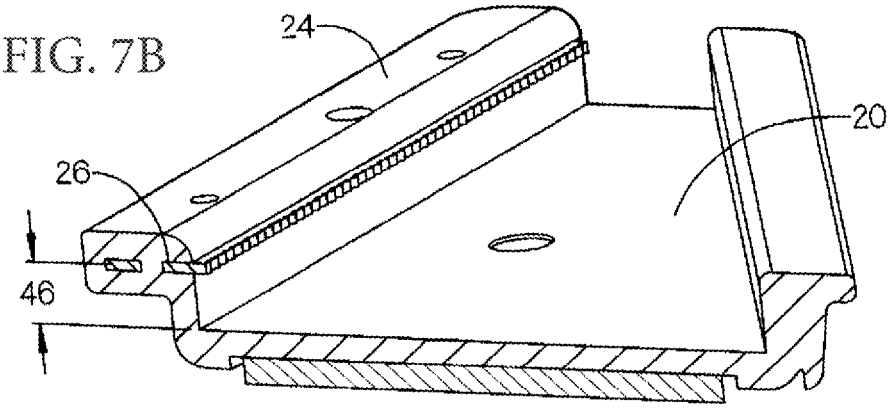

APPLIANCE FOR OPENING SCREW AND TWIST TYPE CONTAINERS

CROSS-REFERENCE TO RELATED APPLICATION(S)

This application is a continuation-in-part of U.S. application patent Ser. No. 14/257,542, filed Apr. 21, 2014, the entire disclosure of which is hereby incorporated by reference.

TECHNICAL FIELD

This disclosure relates generally to an appliance which enables the user to easily open screw or twist type closures on medicine bottles, water bottles, jars of nearly all sizes, and the like.

BACKGROUND

The common problem of how to easily remove screw or twist type closures has become a more significant issue in recent years due to the increasing average age of the population. Also, ailments such as arthritis, tendonitis, and other joint or hand issues, often make opening screw type containers very difficult. Some twist type closures, like prescription medicine bottles, can require significant hand strength, as well as coordination, due to the high turning force that is required, while simultaneously pushing down, in order to open the container. Many screw type caps require significantly increased hand strength due to the need to break plastic or metal tamper prevention tabs during the process of unscrewing the cap. The age old problem of how to easily open a difficult jam, pickle, or other type jar is also easily resolved by the present invention.

A large portion of the currently known screw type openers are of the two hand operated type which required each hand to grip or twist while opposing the other—for example U.S. Pat. No. 0,186,240 A1 to Donahue, U.S. Pat. No. 0,298,508 A1 to Metcalf, U.S. Pat. No. 1,111,998 to Duvall, and U.S. Pat. No. 1,887,152 to Geisler. These openers require two strong opposing hands in order to operate in addition to a significant amount of coordination, strength, and muscle control. In the case of prescription type containers, strength and muscle control are required in both hands, while the user must simultaneously press down, in order to open the container. Using these types of opposing hand operated openers present a significant challenge and do not meet the needs of the elderly, the young, or those with problems of the hands. These types of opposing hand operated openers also have limitations due to the fact that the user must provide both the retaining force and unscrewing torque, while simultaneously holding the container upright and steady. During the use of opposing hand operated openers, a large amount of stress and force is built up and there is a significant risk of spillage when the cap abruptly releases. Many of the two opposing hand operated systems are also expensive with complex mechanisms or multiple parts that often need to be set, or require adjustments, each time they or used.

Automatic jar openers represent another significant portion of the known prior art—for example US Publication 20030079567 A1 to Dubois, and U.S. patent Ser. No. 03/044,597 A1 to Mikhailov. A common problem with the known automatic jar openers is that they are complicated and expensive systems with many moving parts. These products cannot be easily manufactured at a low cost and present significant maintenance and wear issues in use.

These units also can take up significant space in the home or kitchen and normally must be powered, in many cases by batteries or the home electric system, in order to operate.

There are several examples of under cabinet mounted screw type container openers in the prior art—for example U.S. Pat. No. 4,085,632 to Hogan, U.S. Pat. No. 2,671,362 to Wilson, and U.S. Pat. No. 1,841,270 to Aeschbach. These openers often incorporate multiple parts, requiring various internal component fixation techniques, and multiple fasteners. As a result they consist of systems with relatively high manufacturing cost. These openers relate in most cases primarily to metal systems, also making them relatively high in cost and difficult to manufacture. These openers do not incorporate optimum gripping blades, often because the gripping blade is specified to be formed during the metal stamping process along with the body of the component. These openers often utilize very aggressive or large tooth gripping blades which can frequently damage, and sometimes even puncture, the side of the container lid. Often these blades can create sharp burrs on the lid, which can in turn very easily injure the user. The large tooth and aggressive gripping blades of the prior art openers can also provide a significant risk of injury to the user from direct contact with the gripping blade itself. Finally, the large tooth type gripping blades also provide a mechanically inefficient gripping surface, due to the fact that normally only one or two teeth can be engaged at a time to do the work.

These prior art openers are often mechanically inefficient, making them difficult to use. Some prior art openers incorporate a symmetrical V type body commonly having a wide internal angle of approximately 60° to 80°. The wide angle and symmetrical V type openers provide reduced mechanical advantage with respect to gripping the jar lid and require that the user provide additional force to push the container into the opener, while simultaneously twisting, in order to open the container. One example of the prior art is made from metal, while having a symmetrical V geometry, with a very low angle of 10°. This provides for only a very small container size range, while generating very high stresses on the opener itself.

Another example of prior art is a fully metal system with an asymmetrical split V geometry, but with a low included angle of 20°, and having the key components oriented very differently from the present invention. The loading ramp is specified by Miller to be straight, and located on the centerline, providing little mechanical advantage. While the gripping surface is at an offset at an angle from the center line. The system focuses too much mechanical energy toward the straight centerline located sliding surface, and away from the angled gripping surface, which results in significant deformation of the sliding surface as is shown in the Miller patent. The Miller patent results in significantly less energy being efficiently utilized for opening the container. The low included angle, combined with the deformation of the straight sliding surface, makes it difficult to remove the container lid from the opener itself. In order to overcome the high stresses built up in this system due to the aforementioned issues, thick metal cross sections are required by Miller, also making this system relatively expensive to manufacture.

None of the prior art devices offers the new and unique features of the invention disclosed herein.

SUMMARY

The present invention provides an apparatus for opening screw and twist type caps from a screw and twist type containers, having an integral unitary plastic body with a gripping rail and a molded in unidirectional gripping blade with an opposed loading and reaction plane. The apparatus has an asymmetrical split V geometry with the gripping rail and the unidirectional gripping blade member being located on the center line of the asymmetrical split V geometry. The opposed loading and reaction plane is located at an offset angle of approximately 30 degrees relative the center line located gripping rail and unidirectional gripping blade. The apparatus has an adhesive mounting pad for mounting the apparatus body to an external surface such as the bottom of a cabinet or shelf. The user inserts the screw or twist type cap, secured to the container, and uses a simple clockwise twisting motion whereby the lid is quickly and firmly retained by the unidirectional gripping blade member and the opposed loading and reaction plane which allows the user to easily open the cap from the container.

An object of the present invention is to provide an under cabinet mounted appliance for opening screw and twist type containers such as prescription medicine bottles, water bottles, sports drinks, and jars of all sizes by the user both efficiently and with ease.

A further object of the invention is to very efficiently make use of the highly leveraged rotating torque provided by the user in order to pull the container lid tightly into the opener, to maintain the lid in a fixed position, and to provide maximum leverage to the user and in order to greatly ease opening of screw and twist type containers.

Another object of the invention is to provide an inexpensive singular plastic body with an optimized unidirectional gripping rail and blade, with an opposed loading and reaction plane, all having been molded in place, without multiple parts, fasteners, or retention lugs.

A further object of the invention is to provide a fully asymmetrical split V geometry, with a unidirectional gripping rail located on the center line, with a loading and reaction plane opposed to the gripping rail at an optimized 30 degree offset angle.

Another object of the invention is to provide an under cabinet or otherwise mounted appliance which will facilitate the ease of opening screw and twist type containers with lids ranging from 0.5 inches to 4.5 inches in diameter.

A further object of the invention is to provide an optimized (14 to 24 Tooth Per Inch) small tooth, high precision, gripping blade which is very efficient and effective at retaining the screw top caps, without using large gripping blade teeth of prior art which can cause significant damage to the screw top cap while posing a significant risk of injury to the user via direct contact with the gripping blade.

Another object of the invention is to retain the gripping blade with very little (0.070 inches) gripping blade surface protruding and having the remainder of the gripping blade molded into and approximately 95% encapsulated in the body of the appliance.

A further object of the invention is to encapsulate the gripping blade and to additionally provide flow-through port features in the blade which serve to fully integrate and retain the blade while providing enhanced strength to the structure, thereby reducing deformation of the gripping blade wall and allowing more of the user input energy to be focused toward opening the screw type container.

Another object of the invention is to provide an optimum blade height which will interface well with nearly all existing screw and twist type container lids.

A further object of the invention is to provide a structure with peripheral reinforcement members allowing for a flat mounting back plate to accommodate greater than 11 square inches of adhesive mounting foam, or other adhesive material, having sufficient retention to support the appliance during all required loading scenarios and eliminating the need for mounting screws.

Another object of the invention is to provide a system with no user force required to push the container into the opener during operation.

Further objects and advantages are to provide an under cabinet mounted appliance providing ease in opening even the most difficult twist type container or jar via a new and unique system which provides optimum mechanical advantage. This is especially valued by our aging population and those with arthritic conditions as well as tendon, joint, or other hand related issues which can make opening screw type containers, as well as prescription drug bottle type closures, very difficult.

Further objects, advantages, and features of the present invention will become apparent to those persons skilled in this particular area of technology and to others after consideration of the following detailed specification and accompanying drawings.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

FIG. 7A is a perspective section view of the appliance showing the details of the gripping blade height with detail in FIG. 7B) of the location of section A-A.

DETAILED DESCRIPTION

The present invention provides an appliance for opening screw and twist type containers which comprises a one-piece engineering thermoplastic body, having a fully asymmetrical split V type geometry, a centerline positioned gripping rail with an integrally molded, low profile, optimized metal unidirectional gripping blade, and an approximately 30 degree offset from center line loading reaction plane.

Figure 1:
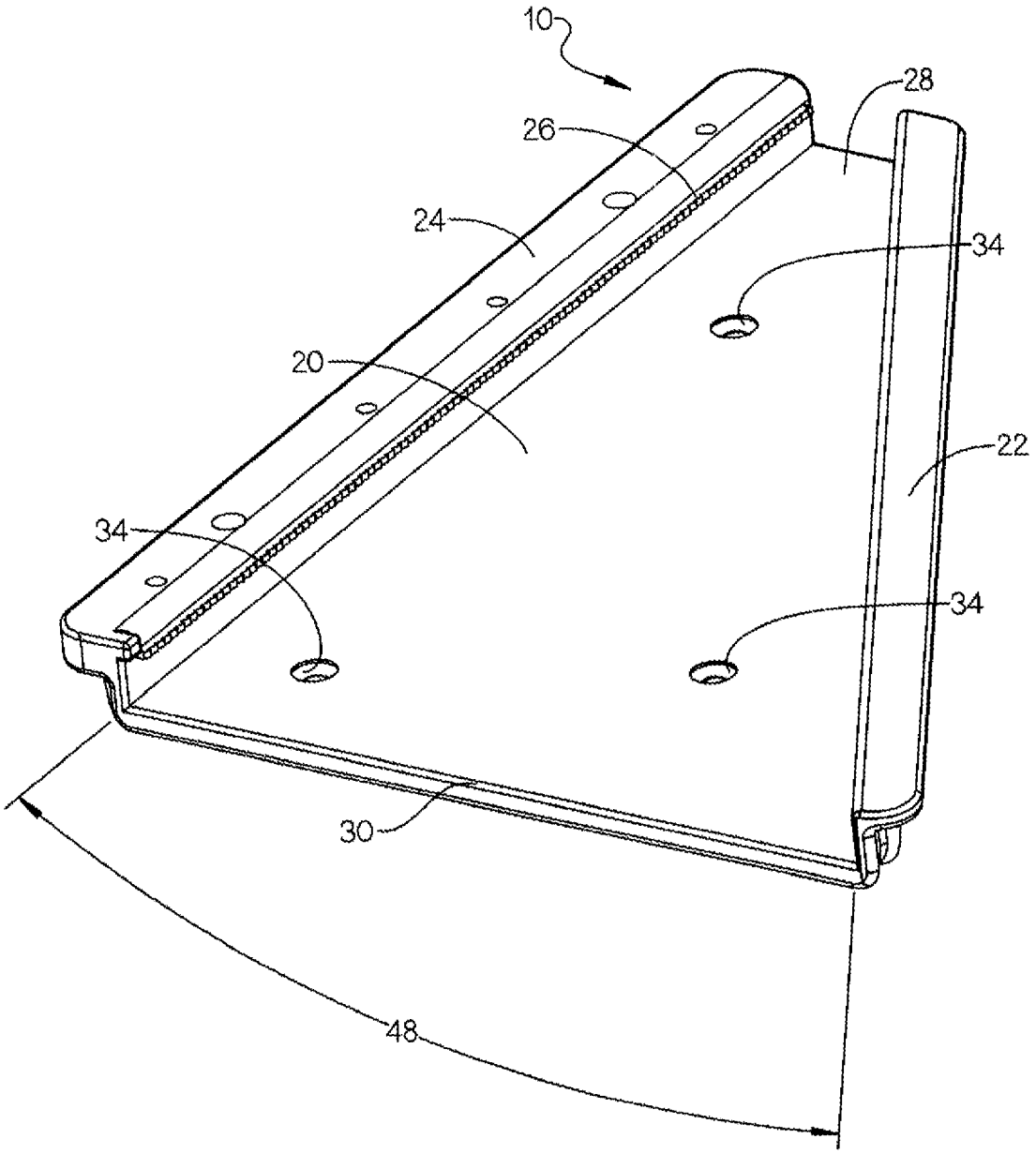
FIG. 1 is an isometric bottom view of the appliance for opening screw type containers.

Referring to FIGS. 1-12, there is shown an appliance for opening screw type containers 10 illustrated in FIG. 1, which enables the user to easily open twist or screw type closures on medicine bottles, water bottles, jars of nearly all sizes, and the like.

Figure 2:
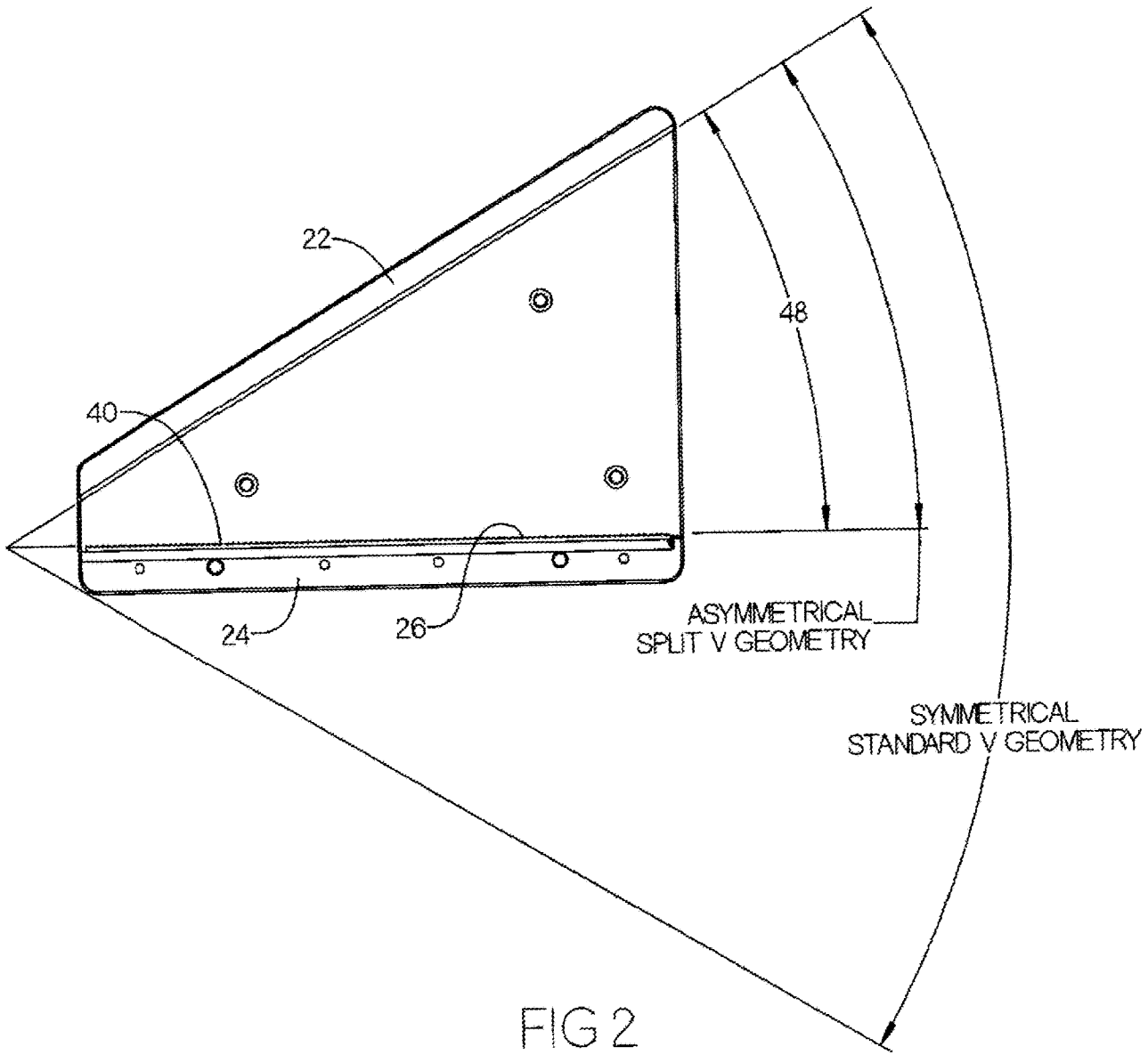
FIG. 2 is a bottom view of the appliance showing the split V geometry with the centerline positioned gripping rail.

The appliance 10 generally includes a singular plastic body having a base 20 and a one piece fully asymmetrical split V geometry. (FIG. 2)

Therefore, the gripping rail 24 and gripping blade member 26 are located precisely on the centerline, or the axis of symmetry, when compared to a standard symmetrical V type of geometry.

The injection molded loading ramp and reaction plane 22 is located at generally at loading and reaction plane offset angle 48, of 30 degrees, plus or minus 5 degrees, from the center line located gripping rail 24 and gripping blade member 26.

The large container forward end 30 can accommodate a maximum lid diameter of 4.5 inches. The small container aft end 28 can accommodate a minimum lid diameter of 0.5 inches.

Optional tapered screw mounting holes 34 are shown in 3 places. The primary mounting method (FIG. 9) entails utilization of adhesive mounting pad 38 which consists of a closed cell polymer foam having double sided high strength adhesive capable of providing up to 90 pounds per square inch of retention force.

FIG. 2 shows the asymmetrical split V geometry of the appliance 10 with the gripping blade member 26 and gripping rail 24 shown as being located on the center line, or axis of symmetry, when compared to the standard symmetrical V type geometry.

The loading and reaction plane 22 is shown and is positioned at the loading and reaction plane off set angle 48 which is generally specified at 30 degrees, plus or minus 5 degrees, from the center line position of the gripping rail 24 and locking teeth 40. (see FIGS. 4A-4D).

The positional location of the locking teeth (40) is on the inboard side of the unidirectional gripping blade member 26 as shown.

Figure 3:
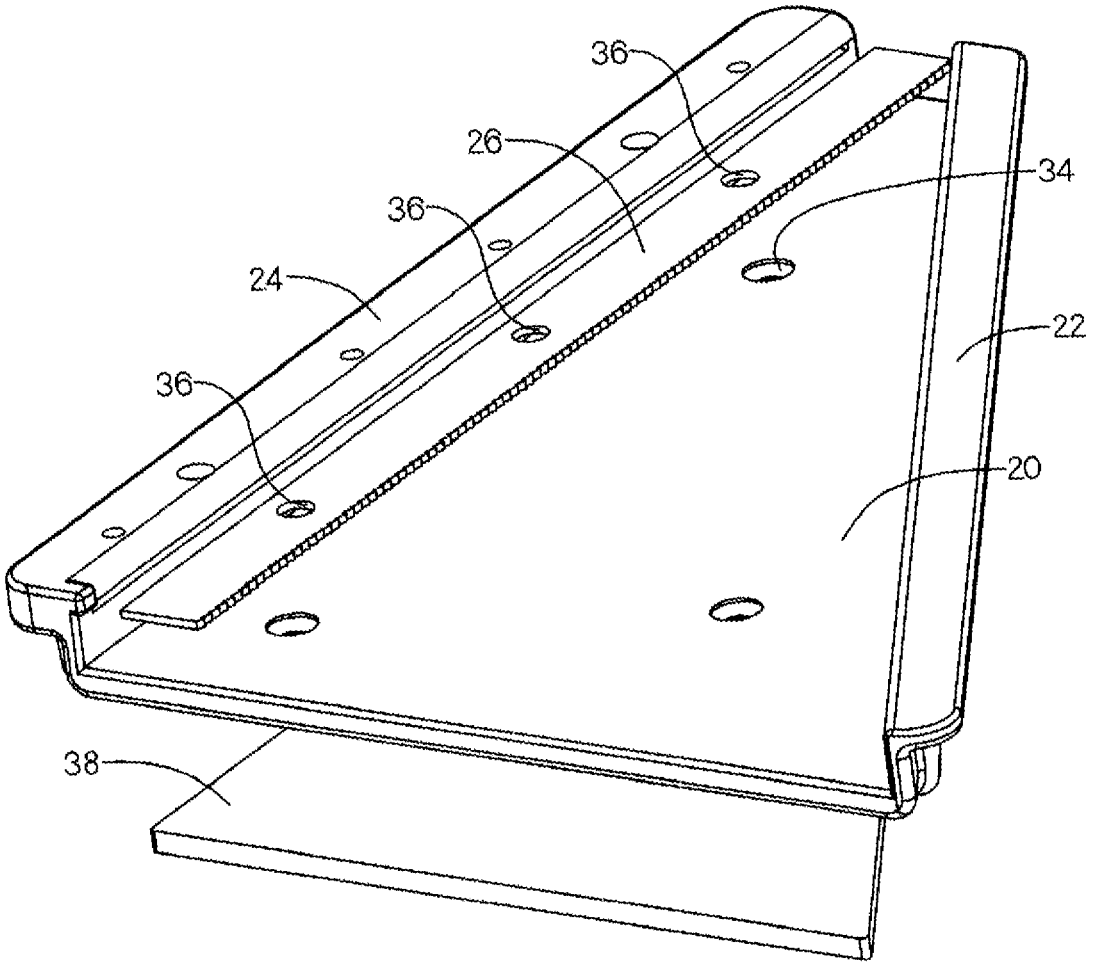
FIG. 3 is an exploded isometric view showing the appliance, unidirectional gripping blade, and adhesive mounting pad.

FIG. 3 shows the integrally molded unidirectional gripping blade member 26, the adhesive mounting pad 38, and the unidirectional gripping blade having flow through blade retention ports 36.

These ports secure the unidirectional gripping blade member 26 in position and provide additional structural stiffness and integrity to the centerline positioned gripping rail 24 which is attached to the appliance for opening screw type containers 10 via the base of appliance 20 and the side wall support gussets 50. (see FIG. 8)

The offset loading ramp and reaction plane 22 also an integrally molded component the appliance 10 and is supported by the base of the appliance 20 and the side wall support gussets 50. (see FIG. 8)

The adhesive mounting pad 38 is attached to the appliance 10 via the mounting base 52 (FIG. 8) and is positioned via the adhesive mounting pad locating wall 54. (see FIG. 8)

Figures 4A, 4B, 4C, 4D:
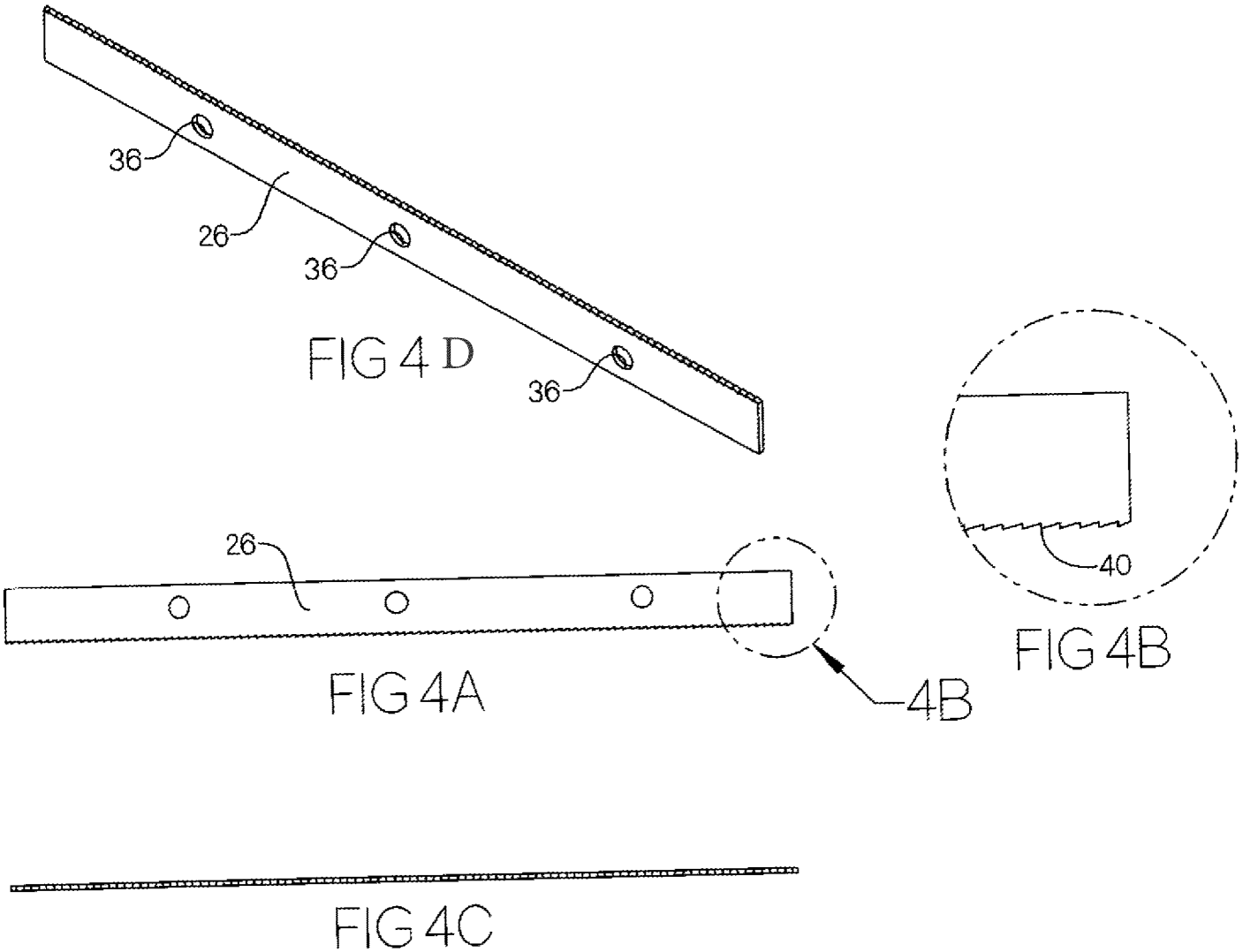
FIGS. 4A-4D are views of the unidirectional gripping blade with a detail of the reverse angled gripping teeth.

FIG. 4D shows the unidirectional gripping blade member 26 and locking teeth 40 (FIG. 4A).

Figure 5A:
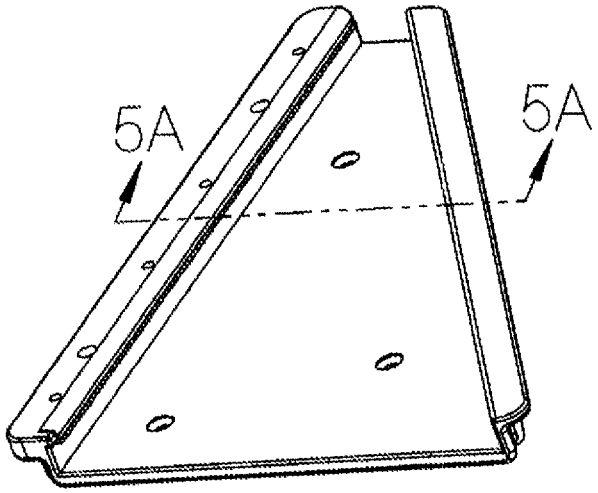
FIG. 5A is an isometric view showing the gripping blade encapsulation and flow through port with FIG. 5B showing detail of the location of section A-A.
Figure 5B:
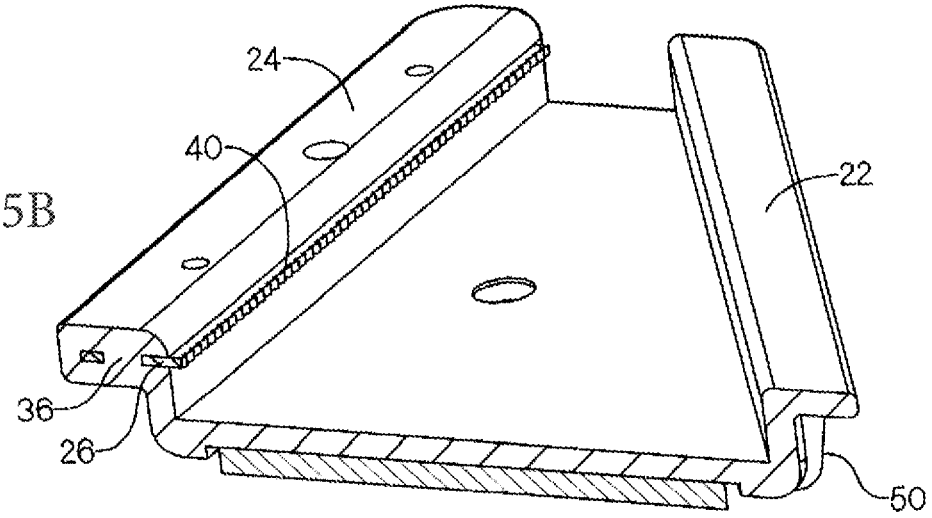

The three flow through blade retention ports 36 in unidirectional gripping blade member 26 serve both to retain the unidirectional gripping blade member 26 and to increase the structural integrity of the centerline positioned gripping rail 24.(see FIG. 5)

In detail (FIG. 4A) the locking teeth 40 can be seen.

The tooth size can range from 14 to 18 teeth per inch and a side to side repeating wave tooth position pattern of +0.5 thickness, 0, and −0.5 thickness is used to provide additional gripping force.

FIG. 5 shows a cross section of the centerline positioned gripping rail 24, unidirectional gripping blade member 26, flow through blade retention port 36, locking teeth 40, offset loading ramp and reaction plane 22, and side wall support gussets 50.

The gripping rail 24 and gripping blade member 26 are integrated during the injection molding process via the flow through blade retention port 36.

Plastic material which forms the gripping rail 24 flows through the blade retention port 36 and leaves a permanent plastic boss of material which positively locates and retains the gripping blade member 26.

This will also provide additional structural strength and integrity to the centerline positioned gripping rail 24.

The additional structural improvement added by the side wall support gussets 50 to the offset loading ramp and reaction plane 22 can also be readily seen in this section view provided in FIG. 5.

The locking teeth 40 of the unidirectional gripping blade member 26 are also shown in FIG. 5.

Figure 6B:
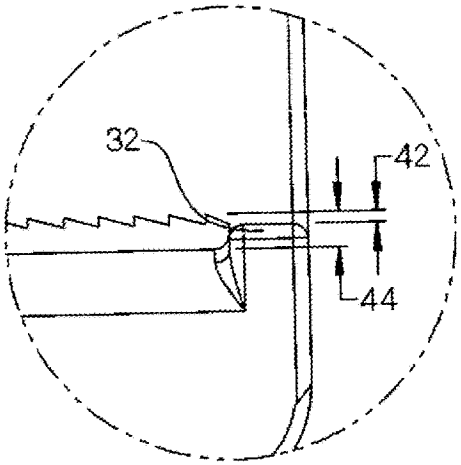
FIG. 6A is a bottom schematic view of the appliance with a detail in FIG. 6B of the gripping blade protrusion and protection stud.

FIG. 6 shows the centerline positioned gripping rail 24, offset loading ramp and reaction plane 22, and loading ramp and reaction plane off set angle 48.

The loading and reaction plane 22 is shown and is located at generally at a 30 degree offset from the center line position the gripping rail 24.

These relative locations of the gripping rail 24 and loading and reaction plane 22 result in the asymmetrical split V geometry (see FIG. 2) of the appliance for opening screw type containers 10.

Figure 6A:
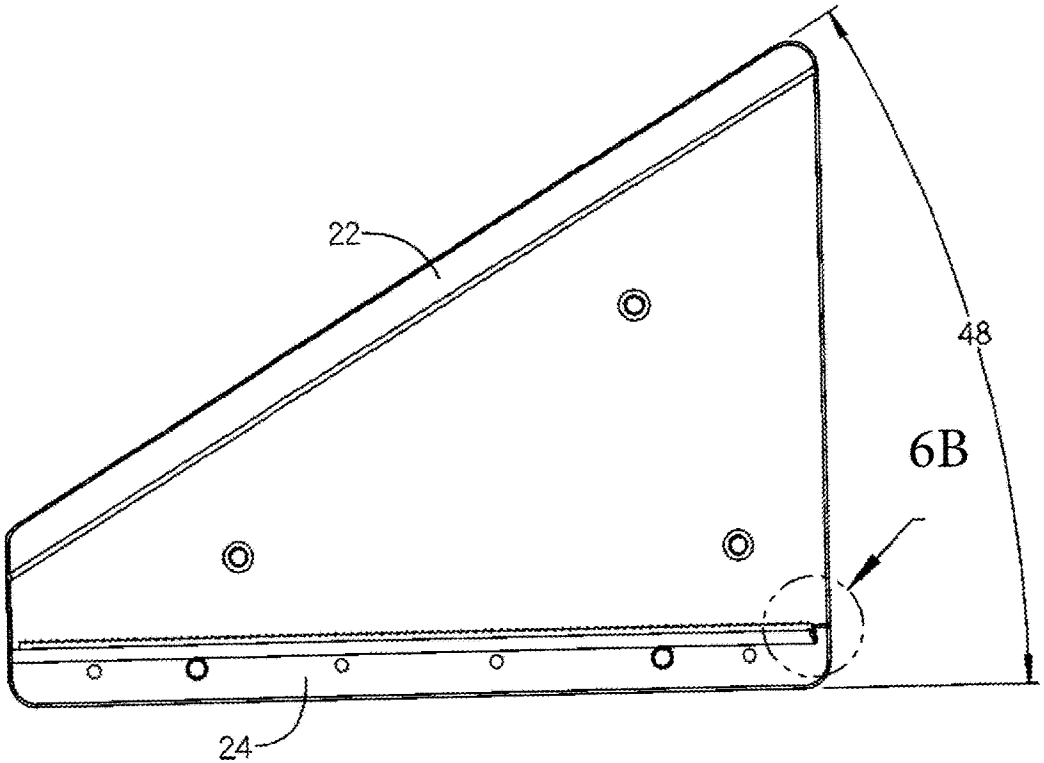

FIG. 6A shows a detail drawing of the gripping blade protrusion height from the protection stud 42, and the gripping blade protrusion from gripping plane 44.

The gripping blade protection stud 32 is provided so that the user cannot achieve direct contact with the forward end of the gripping blade 36.

However, the locking teeth 40 must stand slightly proud of the protection stud 32 so that the larger container lids will engage in the locking teeth 40 effectively.

Due to this requirement, the blade protrusion from protection stud 42 has been designated at 0.030 inches.

Generally, the unidirectional gripping blade member 26 is desired to have a low-profile height or protrusion versus the centerline positioned gripping rail 24.

As a result, the blade protrusion from gripping plane 44 has been designated at 0.070 inches.

FIG. 7 shows a cross section of the appliance for opening screw type containers 10, with the centerline positioned gripping rail 24, the unidirectional gripping blade member 26, the base of appliance 20, and gripping blade height from base of appliance 46.

The gripping blade height from base 46 of appliance has been designated at 0.275 inches.

Figure 8:
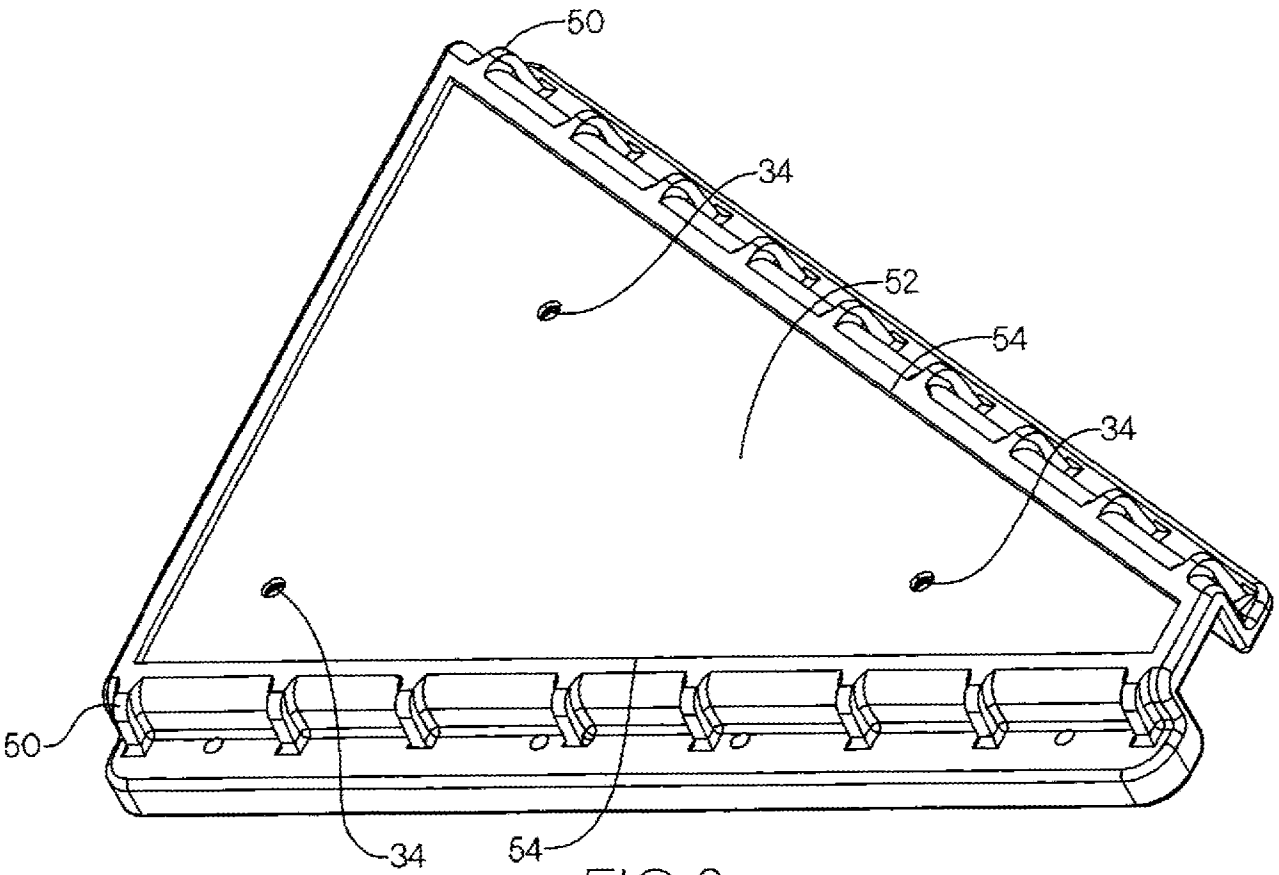
FIG. 8 is an isometric top view of the appliance showing the mounting surface area.

FIG. 8 shows the mounting base 52, adhesive mounting pad locating wall 54, side wall support gussets 50, and optional tapered screw mounting holes 34.

Figure 9:
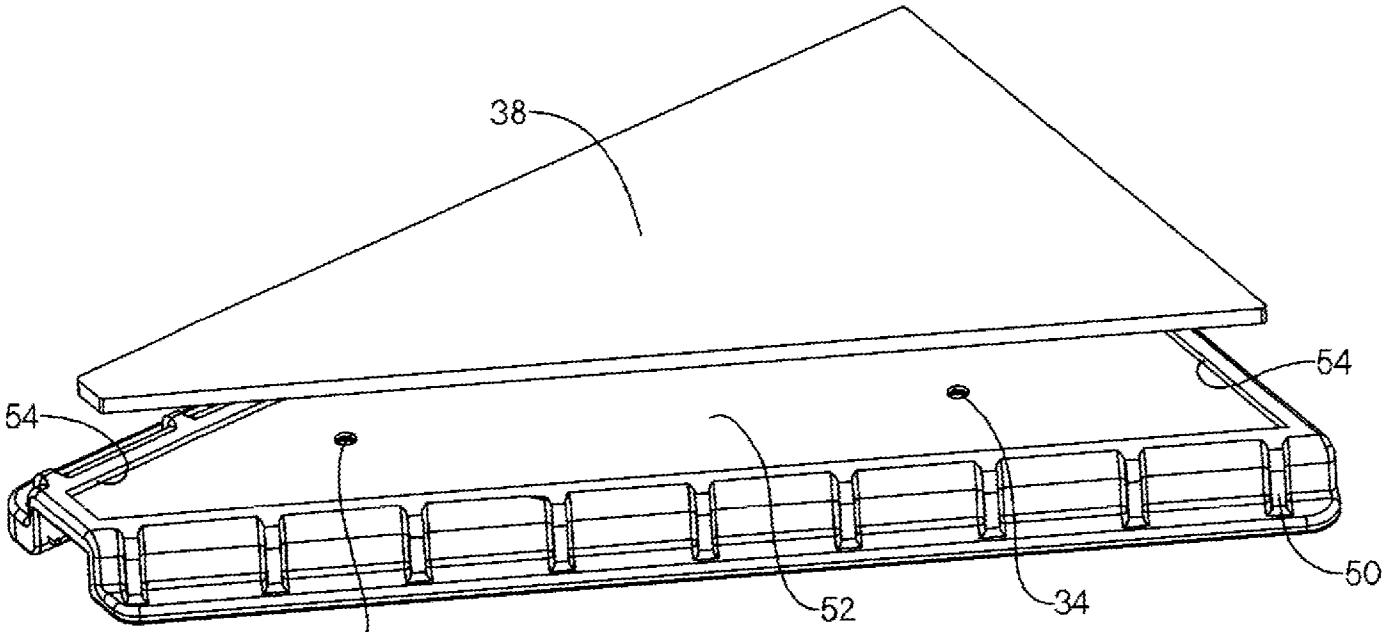
FIG. 9 is an isometric exploded top view of the appliance showing the adhesive mounting pad.

The mounting base 52 provides a structurally sound and flat surface for location of the adhesive mounting pad 38 (FIG. 9).

The adhesive mounting pad locating wall 54 protrudes from the mounting base 52 and also acts as a unifying structural member for the side wall support gussets 50.

The three optional tapered screw mounting holes 34 are located in the mounting base 52.

FIG. 9 shows and exploded view of the adhesive mounting pad 38, mounting base 52, adhesive mounting pad locating wall 54, side wall support gussets 50, and optional tapered screw mounting holes 34.

The adhesive mounting pad 38 is adhesively attached to the appliance mounting base 52 and is located fully with in the boundary created by the adhesive mounting pad locating wall 54.

With many adhesive foams being rated at over 60 pounds per square inch in tensile strength, the overall retention force of the appliance for opening screw type containers 10 can easily exceed 720 pounds.

Figure 10:
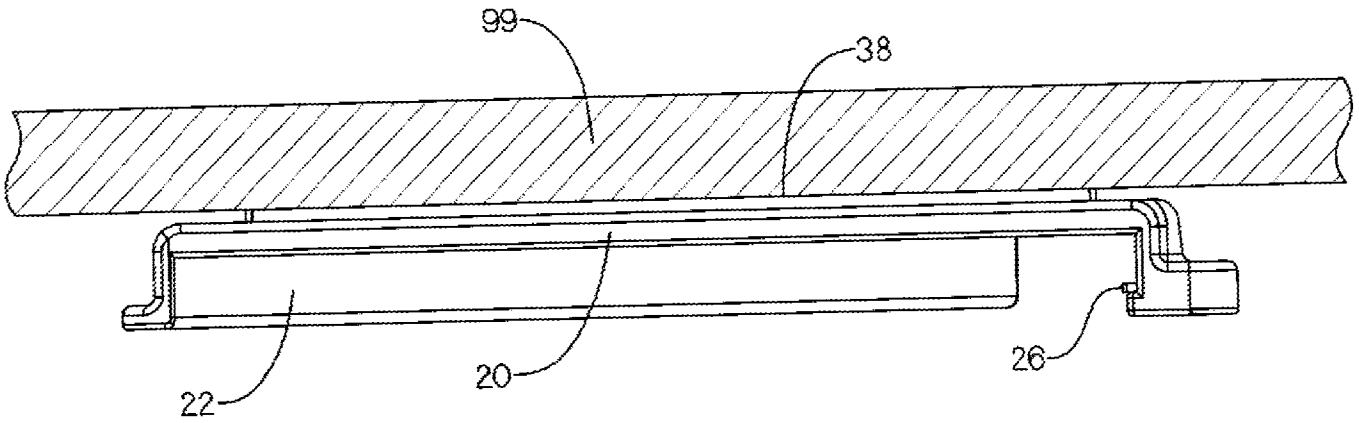
FIG. 10 is a front view of the appliance as mounted on an external surface.

FIG. 10 shows a side view of the appliance for opening screw type containers 10 mounted to and external surface 99 via the adhesive mounting pad 38.

Figure 11A:
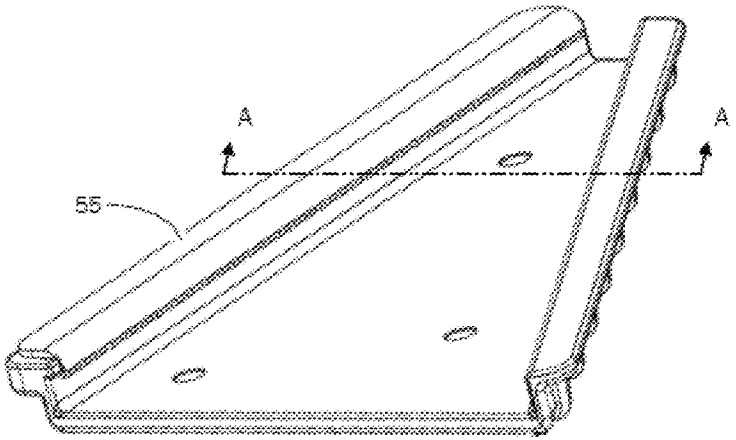
FIG. 11A is a perspective view of the application showing the details of the gripping blade protector pad with detain in FIG. 11B of location A-A.
Figure 11B:
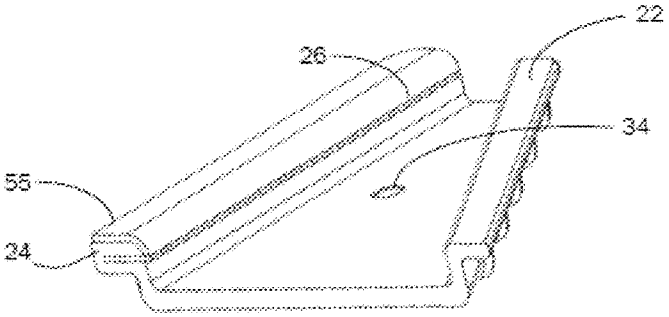

FIG. 11B shows a cross section of the appliance for opening screw type containers 10, with the centerline positioned gripping rail 24, the unidirectional gripping blade member 26, the optional tapered screw mounting hole 34, and the gripping blade proctor pad 55.

Figure 12A:
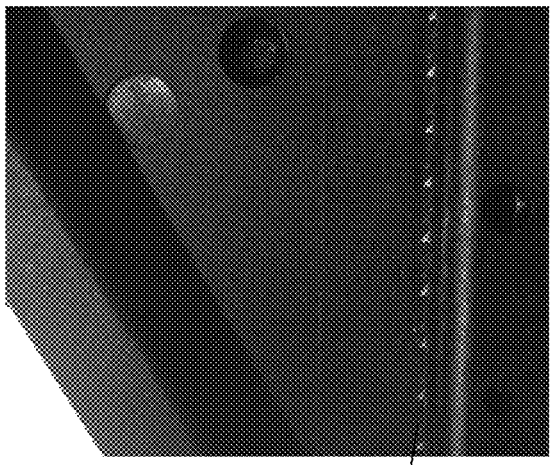
FIG. 12A is a perspective view of the application without the gripping blade protector pad and FIG. 12B is a perspective view of the application with the gripping blade protector pad.
Figure 12B:
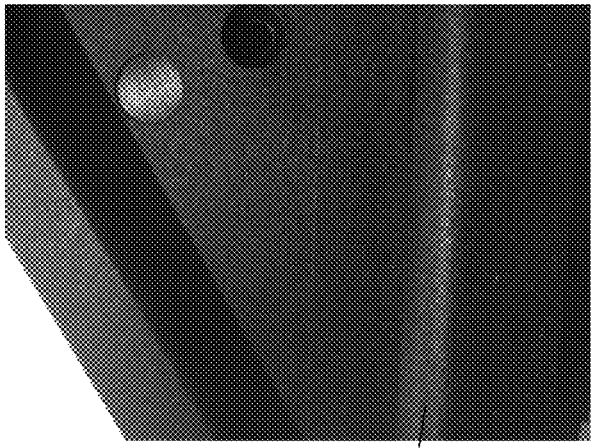

The gripping blade protector pad 55 consists of a foam pad which adhesively mounts to the centerline positioned gripping rail 24 above the unidirectional gripping blade member 26 isolating the reverse angled locking teeth 40. The gripping blade protector pad 55 extends the length of the unidirectional gripping blade member 26. As illustrated in FIGS. 12A and 12B, the gripping blade protector pad 55 has a thickness as least thick enough to cover the unidirectional gripping blade member 26 when the appliance is viewed from the bottom. The thickness of the gripping blade protector pad 55 can be thicker than the unidirectional gripping blade member 26, so long as when pressure is placed on the pad 55 due to, for example, a jar, the foam has sufficient pliability so that the thickness is reduced to allow access of the blade member 26 to the jar.

Operation—FIGS. 1 through 12

The manner of use of the appliance for opening screw type containers 10 contained in the present disclosure is very simple, even for our aging population and those with arthritic conditions or other hand related issues, which can make opening screw type containers, as well as prescription drug bottles, very difficult.

The user first permanently mounts the appliance for opening screw type containers 10 under a cabinet or shelf using the adhesive mounting pad 38 (FIG. 9).

Although generally not required, the optional tapered screw mounting holes 34 can also be used with a standard screw type fastener as a secondary means to mount the appliance.

To use the appliance for opening screw type containers 10 (FIG. 1) the individual first grasps the body of the container which is desired to be opened.

Then user places the lid of container to be opened into direct contact with the base of the appliance 20 and slides the container toward the small end 28 of the appliance 10 until it stops.

The user then starts to turn or twist the container body in a clockwise direction. Because the container body is actually acting as a significant lever and due to the fact that normally both hands are able to work together turning in the same direction, the user is able to generate a significant amount of torque.

The loading ramp and reaction plane 22 has a very smooth and hard surface, with a low coefficient of friction, especially in contrast to the extremely high friction created by the unidirectional optimized gripping blade member 26 and locking teeth 40 (FIG. 4).

Due to the features and position of the gripping rail 24, gripping blade member 26, and locking teeth 40 relative to the loading and reaction plane 22 (FIGS. 1 and 2), the twisting motion provided by the user acts to pull the container lid tightly into the opener appliance 10.

In the use of appliance 10 user force is not required to push the container into the appliance, the user only needs to twist the container body.

The 30 degree off-set loading and reaction plane 22 continues provide a high reaction force which works to drive the container lid into tightly contact with the low profile, high occurrence, reverse angled locking teeth 40 of the gripper blade member 26 completely prohibiting the container lid from turning.

The overall stress in the system of the container, container lid, and appliance for opening screw type containers 10 quickly builds to a high level.

The only available option to relieve the stress in the overall system created by the user's highly leveraged input force which is now focused by the appliance for opening screw type containers 10 is for the container lid to turn independently of the container body, therefore opening the container.

The end result is that the appliance 10 very efficiently focuses the user's highly leveraged input force directly to the container lid, and in the exact opposite direction versus the leveraged container body torque, which results in being able to remove nearly all twist type lids extremely easily and quickly.

The adhesive mounting pad 38 (FIG. 9) provides the user with a simple and convenient method for mounting the appliance for opening screw type containers 10.

The mounting pad will provide in excess of 720 pounds of holding force based on the large amount of surface area provided by the appliance mounting base 52.

The adhesive mounting pad locating wall 54 (FIG. 8) and side wall support gussets 50 provide strength and stiffness to the appliance 10 during use.

This the support gussets 50 reduce flexing and deformation of the appliance 10 and allows for more energy to be focused to the container lid to provide increased efficiency in opening the screw type container. In order to allow the user with the possibility to open a very wide variety of containers, the unidirectional gripping blade member 26 (FIG. 7) and locking teeth 40 are located at a gripping blade height from base of appliance 46 of nominally 0.275 inches.

In order to protect the user from contact with the end of the unidirectional gripping blade member 26 (FIG. 6) and locking teeth 40 a gripping blade protection stud 32 is provided.

To further protect the user the unidirectional gripping blade member 26 and locking teeth (40) the blade protrusion from gripping plane 44 is provided at a nominal distance of 0.070 inches.

To further protect the user, the unidirectional gripping blade member 26 and locking teeth (40) are isolated by a gripping blade protector pad 55 which is provided so that the user cannot achieve direct contact with the gripping blade member 26 during use.

The gripping blade protector pad 55 is made from a durable adhesive foam, allowing for ease of deformation and full engagement of the unidirectional gripping blade member 26 during use, while still providing protection to the user.

To provide the user with increased stiffness, and therefore efficiency in operation, the unidirectional griping blade member 26 (FIG. 5) is integrated with the gripping rail 24 via the flow through blade retention ports 36. To provide the user with extremely high lid retention the unidirectional gripping blade member 26 (FIG. 4) has been specified with locking teeth (40) ranging from 14 to 18 teeth per inch (Detail A).

To provide the user with optimized mechanical advantage and system efficiency the appliance for opening screw type containers 10 (FIG. 2) is provided with an asymmetrical split V geometry and a center line positioned gripping rail 24 with a loading and reaction plane 22 having a loading and reaction plane offset angle 48 specified at a nominal 30 degrees, plus or minus 5 degrees.

The user is provided with a low cost appliance for opening screw type containers 10 (FIG. 1) by incorporating a one piece singular plastic body with an integrally molded loading ramp and reaction plane 22 and center line located gripping rail 24 having a molded in gripping blade member 26.

In order for the user be able to open a wide range of container sizes the large container forward end 30 is specified with a nominal dimension of 4.5 inches and the small container aft end 28 is specified at a nominal dimension of 0.5 inches.

The apparatus can be used to easily open medicine bottles, water bottles, sports drinks, jars of nearly all sizes. It can easily be mounted under the cabinet using the adhesive mounting pad and will provide greatly improved mechanical advantage to assist the elderly and those with arthritis, joint pain, or other hand problems. The ability to use both hands to work together instead of opposing each other is of tremendous benefit when opening screw top containers, while also greatly reducing the potential for spilling or dropping the container while opening.

Furthermore, the apparatus for opening screw type containers has the additional benefits in that

- it provides the increased leverage, lid retention, and gripping force required due to the centrally located gripping rail and offset loading plane with split V geometry;
- it allows for operation via twisting action only and eliminates the need to simultaneously push the container into the opener during use;
- it greatly eases the removal of nearly all twist type lids ranging in size from ½" in diameter to 4½" diameter;
- it provides low profile and small tooth unidirectional gripping blade with improved performance while also allowing for a much safer system with the great majority of the blade being encapsulated and isolated from the user;
- it utilizes a one-piece thermoplastic body with molded in unidirectional gripping blade and loading and reaction plane allowing for a very low manufacturing cost and the possibility for high volume production;
- it provides flow through port features in the gripping blade which serve to fully integrate and retain the blade while adding strength and structure for greater energy focus to the lid and higher efficiency in operation;
- it provides multiple side wall gussets tied into a common locating wall to further stiffen the structure and improve energy focus to the lid and higher efficiency in operation;
- it provides optimized blade height to allow for use with nearly every currently commercially available lid; and
- this new invention is not seen in any other prior art and is highly efficient and effective when opening screw top containers, while being able to be manufactured at a high rate with very low cost.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

REFERENCE NUMBERS

10 appliance for opening screw type containers
20 base of appliance
22 offset loading ramp and reaction plane
24 centerline positioned gripping rail
26 unidirectional gripping blade member
28 small container aft end
30 large container forward end
32 gripping blade protection stud
34 optional tapered screw mounting hole
36 flow through blade retention port
38 adhesive mounting pad
40 reverse angled locking teeth
42 blade protrusion from protection stud
44 blade protrusion from gripping rail
46 gripping blade height from base of appliance
48 loading and reaction plane off set angle
50 side wall support gussets
52 mounting base
54 adhesive mounting pad locating wall
55 gripping blade protector pad
99 external surface

What is claimed is:

1. An apparatus for opening a screw type cap from a screw type container, comprising:

an integral, unitary plastic apparatus body having:

a gripping rail member; and an opposed loading and reaction plane member, wherein the gripping rail member and the opposed loading and reaction plane member are arranged in a V geometry;

a unidirectional gripping blade member molded into the gripping rail member, the unidirectional gripping blade member having a gripping blade with locking teeth, each locking tooth having a point facing toward a closed end of the V geometry, the locking teeth extending a distance from the gripping rail member; and a gripping blade protector pad on the gripping rail member, the gripping blade protector pad having a thickness equal to or greater than the distance the locking teeth extend from the gripping rail member, whereby a user can insert the screw type cap secured to the container between the unidirectional gripping blade member and the opposed loading and reaction plane member, and twist the container in a clockwise direction to open the cap from the container, wherein the gripping blade protector pad prevents contact with the locking teeth until pressure is applied to the gripping blade protector pad, which contracts in thickness when pressure is applied.

2. The apparatus according to claim 1, wherein the unidirectional gripping blade member is molded into and approximately 95% encapsulated in the integral, unitary plastic apparatus body.

3. The apparatus according to claim 1, including:

a gripping blade protection stud extending directly from a forward end of the gripping rail member to prevent the user from directly contacting the unidirectional gripping blade member.

4. The apparatus according to claim 1, including:

a plurality of side wall support gusset members to increase strength and stiffness of the integral unitary plastic apparatus body during use, to reduce flexing and deformation of the integral unitary plastic apparatus body, and to allow more energy to be focused on the container cap to provide increased efficiency in opening the screw type container.

5. The apparatus according to claim 1, wherein the unidirectional gripping blade member includes a plurality of flow-through blade retention ports and the gripping rail member includes an integral plastic boss through each of the flow-through blade retention ports formed from plastic material which forms the gripping rail member during molding of the apparatus that flows through the plurality of flow-through blade retention ports and leaves each permanent plastic boss of plastic material that positively locates, fully integrates and retains the unidirectional gripping blade member in the apparatus, and provides additional structural strength and integrity to the centerline positioned gripping rail member.

6. The apparatus according to claim 1, further comprising a base extending between the gripping rail member and the opposed loading and reaction plane member, wherein the gripping blade member is positioned on the gripping rail member a distance of 0.275 inches from the base.

7. The apparatus according to claim 1, wherein the distance the locking teeth of the gripping blade member protrude from gripping rail member is 0.070 inches.

8. The apparatus according to claim 7, wherein at least 95% of the gripping blade member is molded into the gripping rail member.

9. The apparatus according to claim 1, comprising a large container forward end with a nominal dimension of 4.5 inches and a small container aft end specified at a nominal dimension of 0.5 inches.

10. The apparatus according to claim 1, wherein the opposed loading and reaction plane member is located at an offset angle of approximately 30 degrees relative to the gripping rail member.

11. An apparatus for opening a screw type cap from a screw type container, comprising:

an integral, unitary plastic apparatus body comprising:

a planar base in an asymmetrical split V geometry;

a gripping rail member molded along an edge of the planar base at a center line of the asymmetrical split V geometry;

a gripping blade member of a metal material molded into the gripping rail member in a plane parallel to the planar base, the gripping blade member comprises locking teeth having a tooth pattern of between 14 to 18 teeth per inch and a side-to-side repeating wave pattern; and an opposed loading and reaction plane member molded along another edge of the planar base at an offset angle of approximately thirty degrees relative to the gripping rail member; and a gripping blade protector pad on the gripping rail member which prevents contact with the locking teeth until pressure is applied to the gripping blade protector pad, which contracts in thickness when pressure is applied.

12. The apparatus according to claim 11, wherein the gripping blade member includes a plurality of flow-through blade retention ports and the gripping rail member includes an integral plastic boss through each of the flow-through blade retention ports formed during molding of the apparatus that flows through the plurality of flow-through blade retention ports and leaves each integral plastic to permanently locate and retains the gripping blade member in the gripping rail member.

13. The apparatus according to claim 11, wherein the gripping blade member is positioned on the gripping rail member a distance of 0.275 inches from the base.

14. The apparatus according to claim 11, wherein the teeth of the gripping blade member protrude from gripping rail member a distance of 0.070 inches.

15. The apparatus according to claim 11, wherein at least 95% of the gripping blade member is encapsulated in the gripping rail member.

16. The apparatus according to claim 11, comprising a large container forward end with a nominal dimension of 4.5 inches and a small container aft end specified at a nominal dimension of 0.5 inches.

17. The apparatus according to claim 11, wherein the gripping blade protector pad has a thickness equal to or greater than a distance the locking teeth extend from the gripping rail member.

* * * * *